US009228482B2

(12) United States Patent
Levijoki

(10) Patent No.: US 9,228,482 B2
(45) Date of Patent: Jan. 5, 2016

(54) SYSTEM AND METHOD FOR DIAGNOSING A FAULT IN A SWITCHABLE WATER PUMP FOR AN ENGINE BASED ON A CHANGE IN CRANKSHAFT SPEED

(75) Inventor: Stephen Paul Levijoki, Swartz Creek, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 409 days.

(21) Appl. No.: 13/606,565

(22) Filed: Sep. 7, 2012

(65) Prior Publication Data

US 2014/0072450 A1 Mar. 13, 2014

(51) Int. Cl.

| | |
|---|---|
| ***F04B 49/06*** | (2006.01) |
| ***F01P 5/14*** | (2006.01) |
| ***F04B 49/02*** | (2006.01) |
| ***F04B 51/00*** | (2006.01) |

(52) U.S. Cl.

CPC . *F01P 5/14* (2013.01); *F04B 49/02* (2013.01); *F04B 51/00* (2013.01); *F04B 2203/0605* (2013.01)

(58) Field of Classification Search

CPC ..... F01P 5/14; F01P 11/16; F01P 2025/62; F01P 2031/36; F01P 7/00; F01P 11/18; F01P 11/14; G01M 15/04; G01M 15/00; G01M 17/00; F02D 17/04; F02B 77/08; F02B 3/06; G01N 7/20; G06F 7/00

USPC ..... 417/18, 22, 32, 42, 53, 63, 278, 279, 417/282, 292, 293; 123/41.44, 198 D; 73/114.01, 114.04, 114.22, 114.24, 73/114.25, 114.68

See application file for complete search history.

(56) References Cited

U.S. PATENT DOCUMENTS

| | | | | |
|---|---|---|---|---|
| 3,817,224 | A * | 6/1974 | Pluequet et al. | 123/41.15 |
| 5,754,971 | A * | 5/1998 | Matsumoto et al. | 701/103 |
| 6,169,953 | B1 | 1/2001 | Panoushek et al. | |
| 6,343,572 | B1 | 2/2002 | Pfaff et al. | |
| 6,397,820 | B1 | 6/2002 | Novak et al. | |
| 6,668,766 | B1 * | 12/2003 | Liederman et al. | 123/41.44 |
| 6,745,726 | B2 * | 6/2004 | Joyce et al. | 123/41.1 |
| 6,758,172 | B2 * | 7/2004 | Morgan et al. | 123/41.08 |

(Continued)

FOREIGN PATENT DOCUMENTS

| | | |
|---|---|---|
| CN | 102076937 A | 5/2011 |
| DE | 19728351 A1 | 1/1999 |

(Continued)

OTHER PUBLICATIONS

Non-Final Office Action dated Jan. 6, 2014 in U.S. Appl. No. 13/269,048; 6 pages.

Non-Final Office Action dated Jan. 3, 2014 in U.S. Appl. No. 13/111,318; 5 pages.

U.S. Appl. No. 13/269,048, filed Oct. 7, 2011, Daniel A. Bialas et al.

U.S. Appl. No. 13/111,318, filed May 19, 2011, Daniel A. Bialas et al.

Glossary of Judicial Claim Constructions in the Electronics, Computer and Business Method Arts.

*Primary Examiner* — Justin Jonaitis
*Assistant Examiner* — Stephen Mick

(57) ABSTRACT

A system according to the principles of the present disclosure includes a pump control module and a pump diagnostic module. The pump control module commands a water pump to switch between on and off, wherein the water pump circulates coolant through an engine when the water pump switches on as commanded. The pump diagnostic module diagnoses a fault in the water pump based on a change in a crankshaft speed of the engine when the water pump is commanded to switch between on and off.

22 Claims, 4 Drawing Sheets

(56) References Cited

U.S. PATENT DOCUMENTS

| | | | | |
|---|---|---|---|---|
| 6,802,283 | B2 * | 10/2004 | Liederman et al. | 123/41.12 |
| 7,409,928 | B2 | 8/2008 | Rizoulis et al. | |
| 7,997,510 | B2 | 8/2011 | Pavia et al. | |
| 8,224,517 | B2 | 7/2012 | Eser et al. | |
| 8,813,692 | B2 | 8/2014 | Bialas et al. | |
| 8,813,693 | B2 * | 8/2014 | Bialas et al. | 123/41.15 |
| 2010/0038158 | A1 * | 2/2010 | Whitney et al. | 180/65.265 |
| 2011/0098883 | A1 * | 4/2011 | Eser et al. | 701/35 |
| 2011/0120216 | A1 * | 5/2011 | Sugimoto | 73/114.68 |
| 2012/0215397 | A1 | 8/2012 | Anilovich et al. | |
| 2013/0089436 | A1 * | 4/2013 | Bialas et al. | 417/32 |
| 2014/0072450 | A1 | 3/2014 | Levijoki | |

FOREIGN PATENT DOCUMENTS

| | | | |
|---|---|---|---|
| DE | 10316753 | A1 | 10/2003 |
| DE | 10334501 | A1 | 3/2004 |
| DE | 102008032130 | A1 | 1/2010 |
| DE | 102012208003 | A1 | 11/2012 |
| DE | 102012218133 | A1 | 4/2013 |

* cited by examiner

SYSTEM AND METHOD FOR DIAGNOSING A FAULT IN A SWITCHABLE WATER PUMP FOR AN ENGINE BASED ON A CHANGE IN CRANKSHAFT SPEED

FIELD

The present disclosure relates to systems and methods for diagnosing a fault in a switchable water pump for an engine based on a change in crankshaft speed.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine water pumps are typically belt-driven centrifugal pumps that circulate coolant through an engine to cool the engine. Coolant is received through an inlet located near the center of a pump, and an impeller in the pump forces the coolant to the outside of the pump. Coolant is received from a radiator, and coolant exiting the pump flows through an engine block and a cylinder head before returning to the radiator.

In a conventional water pump, the impeller is always engaged with a belt-driven pulley. Thus, the pump circulates coolant through the engine whenever the engine is running. In contrast, a switchable water pump includes a clutch that engages and disengages the impeller to switch the pump on and off, respectively. The pump may be switched off to reduce the time required to warm the engine at startup and/or to improve fuel economy, and the pump may be switched on to cool the engine. However, the pump may not switch on or off as commanded due to, for example, a stuck clutch.

SUMMARY

A system according to the principles of the present disclosure includes a pump control module and a pump diagnostic module. The pump control module commands a water pump to switch between on and off, wherein the water pump circulates coolant through an engine when the water pump switches on as commanded. The pump diagnostic module diagnoses a fault in the water pump based on a change in a crankshaft speed of the engine when the water pump is commanded to switch between on and off.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
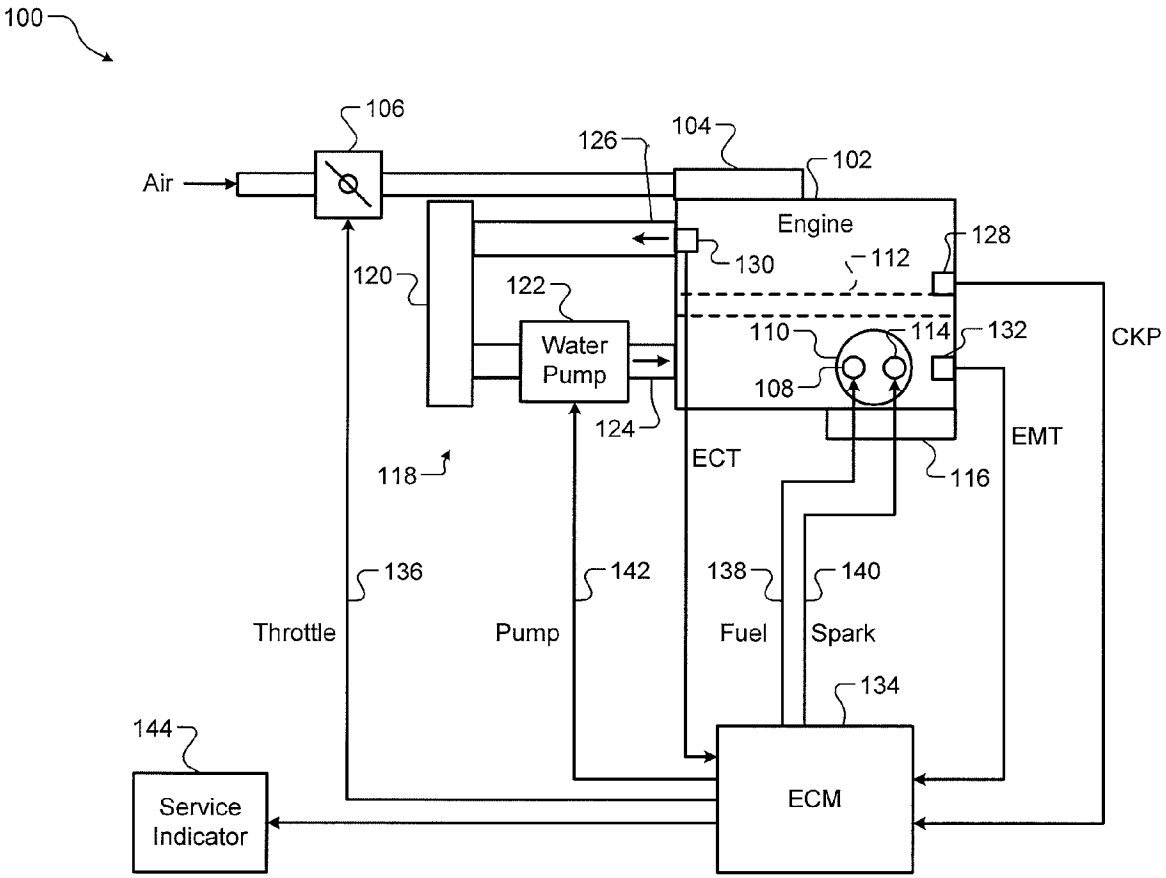
FIG. 1 is a functional block diagram of an example engine system according to the principles of the present disclosure.

A control system and method may switch a water pump on or off based on cooling demands of an engine. The water pump may be switched off to reduce the time required to warm the engine at startup and/or to improve fuel economy. The water pump may be switched on to cool the engine. When the water pump switches on or off as commanded, the speed of a crankshaft coupled to the water pump changes. When the water pump switches on as commanded, the crankshaft speed may decrease. When the water pump switches off as commanded, the crankshaft speed may increase.

A system and method according to the present disclosure diagnoses a fault in a water pump based on a change in crankshaft speed when the water pump is switched on or off. For example, a pump fault may be diagnosed when crankshaft acceleration is less than a predetermined acceleration after the water pump is switched on or off. Additionally or alternatively, a pump fault may be diagnosed when crankshaft jerk is less than a predetermined jerk after the water pump is switched on or off.

A system and method according to the present disclosure may also diagnose a pump fault based on the difference between an engine material temperature (EMT) and an engine coolant temperature (ECT) when the water pump is switched on. The EMT is the temperature of the material from which an engine is made. For example, the EMT may be measured in a cylinder head and/or in an engine block. When the water pump switches from off to on, the difference between the EMT and the ECT decreases.

However, if the water pump is stuck on or off, switching on the water pump does not decrease the difference between the EMT and the ECT. Thus, a pump fault may be diagnosed based on the difference between the EMT and the ECT when the water pump is switched on. A pump fault may be diagnosed based on a maximum decrease in the difference between the EMT and the ECT during a diagnostic period after the water pump is switched on. For example, a stuck-on fault or a stuck-off fault may be diagnosed when the maximum decrease is less than a first threshold. However, a pump fault may not be diagnosed when the maximum decrease is less than the first threshold if the crankshaft speed change does not satisfy certain criteria. Diagnosing a pump fault based on the crankshaft speed change, in addition to the ECT and the EMT, may improve the reliability of pump fault diagnoses.

The stuck-off fault may be diagnosed when the difference between the EMT and the ECT is greater than a second threshold at the end of the diagnostic period. The stuck-on fault may be diagnosed when the difference between the EMT and the ECT is less than or equal to the second threshold at the end of the diagnostic period. A diagnostic trouble code (DTC) may be set and/or a service indicator, such as a light, may be activated when the stuck-on fault or the stuck-off fault is diagnosed. In addition, torque output of the engine may be limited when the stuck-off fault is diagnosed.

Diagnosing a water pump that is stuck off and limiting engine torque output when the water pump is stuck off prevents engine damage due to overheating. Activating a service indicator when the water pump is stuck off may also prevent engine damage if the water pump is replaced when the service indicator is activated. Preventing engine damage reduces warranty costs and increases customer satisfaction. Activating a service indicator when the water pump is stuck on may improve fuel economy if the water pump is replaced when the service indicator is activated. Setting a DTC when a pump fault is diagnosed improves service diagnostic capabilities.

Referring to FIG. 1, an engine system 100 includes an engine 102, which generates drive torque for a vehicle. While the engine 102 is shown and will be discussed as a spark-ignition, the engine 102 may be another suitable type of engine, such as a compression-ignition engine. Air is drawn into the engine 102 through an intake manifold 104. Airflow into the engine 102 may be varied using a throttle valve 106. One or more fuel injectors, such as a fuel injector 108, mix fuel with the air to form an air/fuel mixture. The air/fuel mixture is combusted within cylinders of the engine 102, such as a cylinder 110. Although the engine 102 is depicted as including one cylinder, the engine 102 may include more than one cylinder.

The cylinder 110 includes a piston (not shown) that is mechanically linked to a crankshaft 112. One combustion cycle within the cylinder 110 may include four phases: an intake phase, a compression phase, a combustion phase, and an exhaust phase. During the intake phase, the piston moves toward a bottommost position and draws air into the cylinder 110. During the compression phase, the piston moves toward a topmost position and compresses the air or air/fuel mixture within the cylinder 110.

During the combustion phase, spark from a spark plug 114 ignites the air/fuel mixture. The combustion of the air/fuel mixture drives the piston back toward the bottommost position, and the piston drives rotation of the crankshaft 112. Resulting exhaust gas is expelled from the cylinder 110 through an exhaust manifold 116 to complete the exhaust phase and the combustion cycle. The engine 102 outputs torque to a transmission (not shown) via the crankshaft 112.

A cooling system 118 for the engine 102 includes a radiator 120 and a water pump 122. The radiator 120 cools coolant that flows through the radiator 120, and the water pump 122 circulates coolant through the engine 102 and the radiator 120. Coolant flows from the radiator 120 to the water pump 122, from the water pump 122 to the engine 102 through an inlet hose 124, and from the engine 102 back to the radiator 120 through an outlet hose 126.

The water pump 122 may be a switchable water pump. In one example, the water pump 122 is a centrifugal pump including an impeller and a clutch that selectively engages the impeller with a pulley driven by a belt connected to the crankshaft 112. The clutch engages the impeller with the pulley and disengages the impeller from the pulley when the water pump 122 is switched on and off, respectively. Coolant may enter the water pump 122 through an inlet located near the center of the water pump 122, and the impeller may force the coolant radially outward to an outlet located at the outside of the water pump 122. Alternatively, the water pump 122 may be an electric pump.

A crankshaft position (CKP) sensor 128 measures the position of the crankshaft 112. An engine coolant temperature (ECT) sensor 130 measures the temperature of coolant circulated through the engine 102. The ECT sensor 130 may be positioned in the coolant near the outlet of the engine 102. An engine material temperature (EMT) sensor 132 measures the temperature of the material (e.g., steel, aluminum) from which the engine 102 is made. The EMT sensor 132 may be positioned in the material of an engine block of the engine 102 or a cylinder head of the engine 102.

An engine control module (ECM) 134 controls the throttle valve 106, the fuel injector 108, and the spark plug 114, and the water pump 122 based on input received from the sensors. The ECM 134 outputs a throttle control signal 136 to control the throttle valve 106. The ECM 134 outputs a fuel control signal 138 to control the fuel injector 108. The ECM 134 outputs a spark control signal 140 to control the spark plug 114. The ECM 134 outputs a pump control signal 142 to control the water pump 122.

The ECM 134 determines crankshaft speed based on the crankshaft position and diagnoses a fault in the water pump 122 based on a change in the crankshaft speed when the water pump 122 is switched on or off. The ECM 134 may set a diagnostic trouble code (DTC) and/or activate a service indicator 144 when a fault is diagnosed. The service indicator 144 indicates that service is required using a visual message (e.g., text), an audible message (e.g., chime), and/or a tactile message (e.g., vibration).

Figure 2:
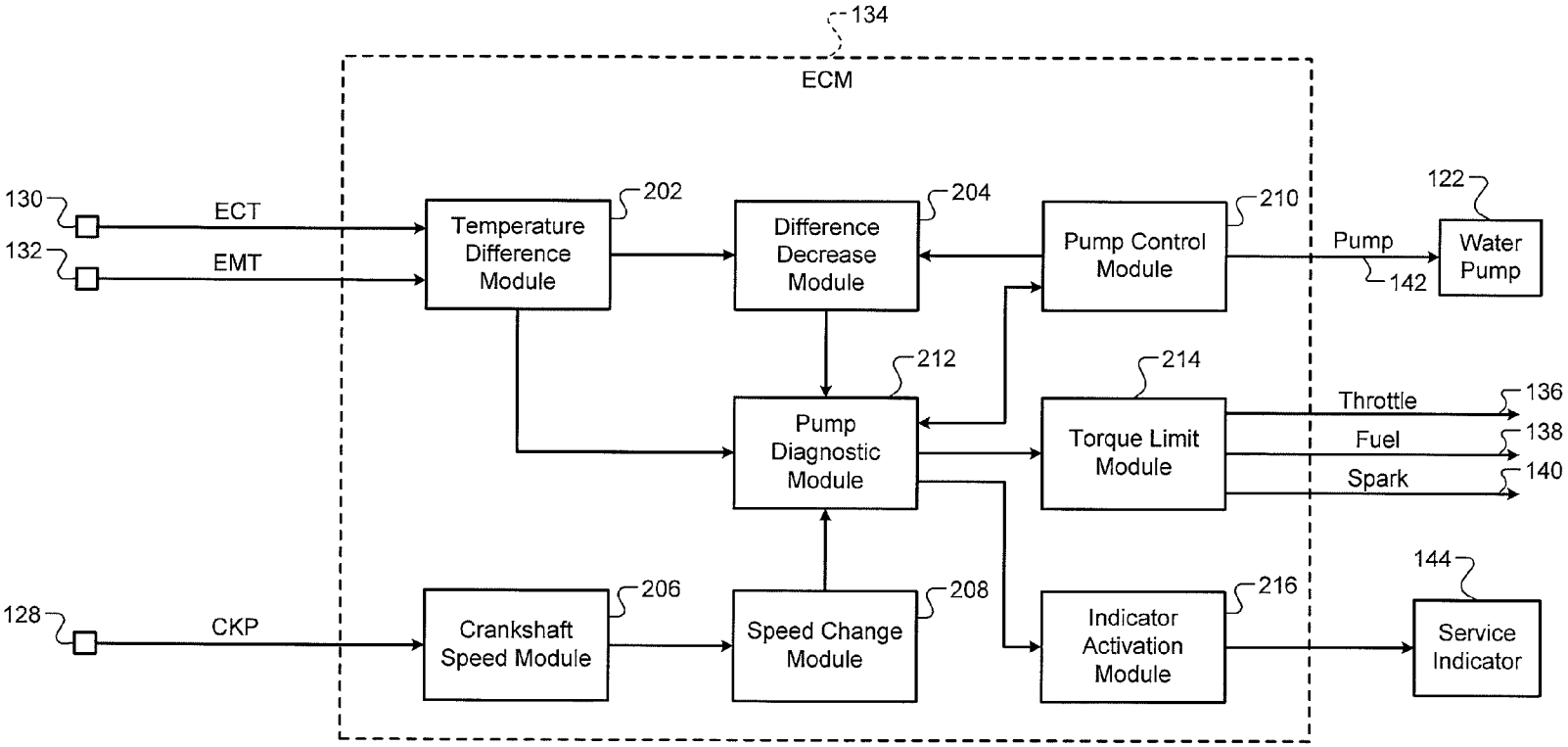
FIG. 2 is a functional block diagram of an example control system according to the principles of the present disclosure.

Referring to FIG. 2, an example implementation of the ECM 134 includes a temperature difference module 202, a difference decrease module 204, a crankshaft speed module 206, a speed change module 208, and a pump diagnostic module 212. The temperature difference module 202 determines a first difference between the engine coolant temperature and the engine material temperature based on input received from the ECT sensor 130 and the EMT sensor 132. The temperature difference module 202 outputs the first difference.

The difference decrease module 204 determines a maximum decrease in the first difference during a diagnostic period. The diagnostic period starts when the water pump 122 is switched on, and the diagnostic period may end after a predetermined duration (e.g., 12 seconds). The difference decrease module 204 may determine when the water pump 122 is switched on based on input received from the pump control module 210. The difference decrease module 204 outputs the maximum decrease.

The difference decrease module 204 may determine the maximum decrease based on a second difference between a maximum value and a minimum value of the first difference during the diagnostic period. The difference decrease module 204 may determine the maximum value of the first difference during a first portion of the diagnostic period. The difference decrease module 204 may determine the minimum value of the first difference during a second portion of the diagnostic period that follows the first portion. The first portion may have a predetermined duration (e.g., 3 seconds) and the second portion may have a predetermined duration (e.g., 9 seconds). The sum of the predetermined duration of the first portion and the predetermined duration of the second portion may be equal to the predetermined duration of the diagnostic period.

The crankshaft speed module 206 determines the speed of the crankshaft 112 based on input from the CKP sensor 128. For example, the crankshaft speed module 206 may calculate the crankshaft speed based on a period that elapses as the crankshaft 112 completes one or more revolutions. The crankshaft speed module 206 outputs the crankshaft speed.

The speed change module 208 determines a change in the crankshaft speed. The crankshaft speed change may include crankshaft acceleration and/or crankshaft jerk. Crankshaft acceleration is a derivative of crankshaft speed with respect to time. Crankshaft jerk is a derivative of crankshaft acceleration with respect to time. The speed change module 208 outputs the crankshaft speed change.

The pump control module 210 controls the water pump 122. The pump control module 210 switches the water pump 122 on and off based on cooling demands of the engine 102. The pump control module 210 may switch the water pump 122 off to reduce the time required to warm the engine 102 at startup and/or to improve fuel economy. The pump control module 210 may switch the water pump 122 on to cool the engine 102. The pump control module 210 may determine the cooling demands of the engine 102 based on the engine material temperature, the engine coolant temperature, and/or engine runtime. The pump control module 210 may control the water pump 122 based on input received from a heating, ventilation, and air conditioning system.

The pump diagnostic module 212 diagnoses a pump fault (i.e., a fault in the water pump 122) based on the crankshaft speed change when the water pump 122 is switched on or off. The pump diagnostic module 212 may determine when the water pump 122 is switched on or off based on input received from the pump control module 210. The pump diagnostic module 212 may diagnose pump fault based on the crankshaft speed change, or a maximum value thereof, within a predetermined period (e.g., 5 seconds) after the water pump 122 is switched on or off.

The pump diagnostic module 212 may diagnose a pump fault when the crankshaft speed change, or an absolute value thereof, is less than a first threshold after the water pump 122 is switched on or off. The pump diagnostic module 212 may diagnose a pump fault when an absolute value of the crankshaft acceleration is less than a predetermined acceleration after the water pump 122 is switched on or off. Additionally or alternatively, the pump diagnostic module 212 may diagnose a pump fault when an absolute value of the crankshaft jerk is less than a predetermined jerk after the water pump 122 is switched on or off.

The pump diagnostic module 212 may also diagnose a pump fault based on the first difference between the engine material temperature and the engine coolant temperature when the water pump 122 is switched on. The pump diagnostic module 212 may not diagnose a pump fault based on the first difference when the water pump 122 is switched off for less than a minimum period (e.g., 20 seconds) before the water pump 122 is switched on. The minimum period allows the engine material temperature to increase relative to the engine coolant temperature. The crankshaft speed change may still be used to diagnose a pump fault when the minimum period is not satisfied.

The pump diagnostic module 212 may diagnose a stuck-on fault or a stuck-off fault in the water pump 122 when the maximum decrease in the first difference during the diagnostic period is less than a second threshold. The pump diagnostic module 212 may determine the first threshold based on ambient temperature, which may be measured or estimated. The second threshold may be a predetermined value (e.g., 4 degrees Celsius (° C.)) or within a predetermined range (e.g., 2° C. to 5° C.).

The pump diagnostic module 212 may diagnose the stuck-on fault when the maximum decrease is less than the second threshold and the first difference is less than or equal to a third threshold at the end of the diagnostic period. The third threshold may be a predetermined value (e.g., 6° C.) or within a predetermined range (e.g., 5° C. to 12° C.). The pump diagnostic module 212 may diagnose the stuck-off fault when the maximum decrease is less than the second threshold and the first difference is greater than the third threshold at the end of the diagnostic period.

The pump diagnostic module 212 may not diagnose a stuck-on fault or a stuck-off fault when the maximum decrease in the first difference during the diagnostic period is greater than the second threshold. Additionally, the pump diagnostic module 212 may not diagnose a stuck-on fault or a stuck-off fault when the crankshaft speed change is greater than the first threshold. Thus, depending on the crankshaft speed change, the pump diagnostic module 212 may not diagnose a stuck-on fault or a stuck-off fault when the maximum decrease in the first difference during the diagnostic period is less than the second threshold.

A torque limit module 214 controls the torque output of the engine 102 by outputting the throttle control signal 136, the fuel control signal 138, and/or the spark control signal 140. The torque limit module 214 may limit the torque output of the engine 102 when a pump fault such as a stuck-off fault is diagnosed. The torque limit module 214 may limit the torque output of the engine 102 by adjusting the throttle control signal 136, the fuel control signal 138, and/or the spark control signal 140. For example, the torque limit module 214 may limit the torque output of the engine 102 by reducing a fueling rate, retarding spark, and/or reducing a throttle area.

The indicator activation module 216 activates the service indicator 144 when, for example, a pump fault is diagnosed. The indicator activation module 216 may also set a diagnostic trouble code (DTC) when a pump fault is diagnosed. The indicator activation module 216 may store the DTC, and a service technician may retrieve the DTC using, for example, a service tool that communicates with the ECM 134.

Figure 3:
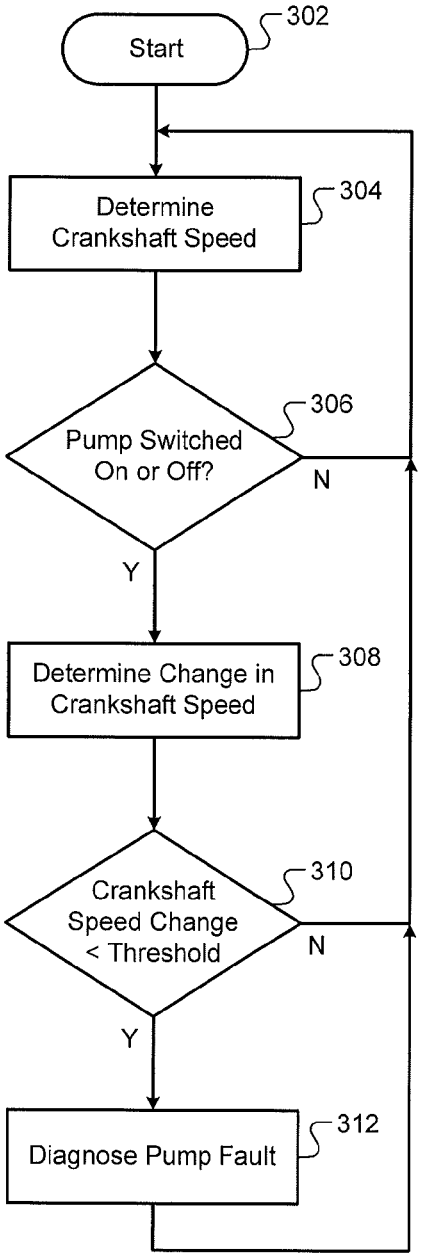
FIGS. 3 and 4 are flowcharts illustrating example control methods according to the principles of the present disclosure.

Referring to FIG. 3, a method for diagnosing faults in a switchable water pump based on a change in crankshaft speed starts at 302. At 304, the method determines the crankshaft speed. The method may determine the crankshaft speed based on input received from a crankshaft position sensor.

At 306, the method determines whether the water pump is switched on or off. If the water pump is switched on or off, the method continues at 308. Otherwise, the method continues at 304. At 308, the method determines a change in the crankshaft speed. The crankshaft speed change may include crankshaft acceleration and/or crankshaft jerk.

At 310, the method determines whether the crankshaft speed change is less than a threshold, which may be a predetermined value. For example, the method may determine whether the crankshaft acceleration is less than a predetermined acceleration and/or whether the crankshaft jerk is less than a predetermined jerk. If the crankshaft speed change is less than the threshold, the method continues at 312. Otherwise, the method continues at 304.

At 312, the method diagnoses a pump fault (i.e., a fault in the water pump). The method may diagnose a pump fault based on the crankshaft speed change, or a maximum value thereof, within a predetermined period (e.g., 5 seconds) after the water pump is switched on or off. For example, the method may diagnose a pump fault when a maximum absolute value of the crankshaft acceleration within the predetermined period is less than the predetermined acceleration. Additionally or alternatively, the method may diagnose a pump fault when a maximum absolute value of the crankshaft jerk within the predetermined period is less than the predetermined jerk.

Figure 4:
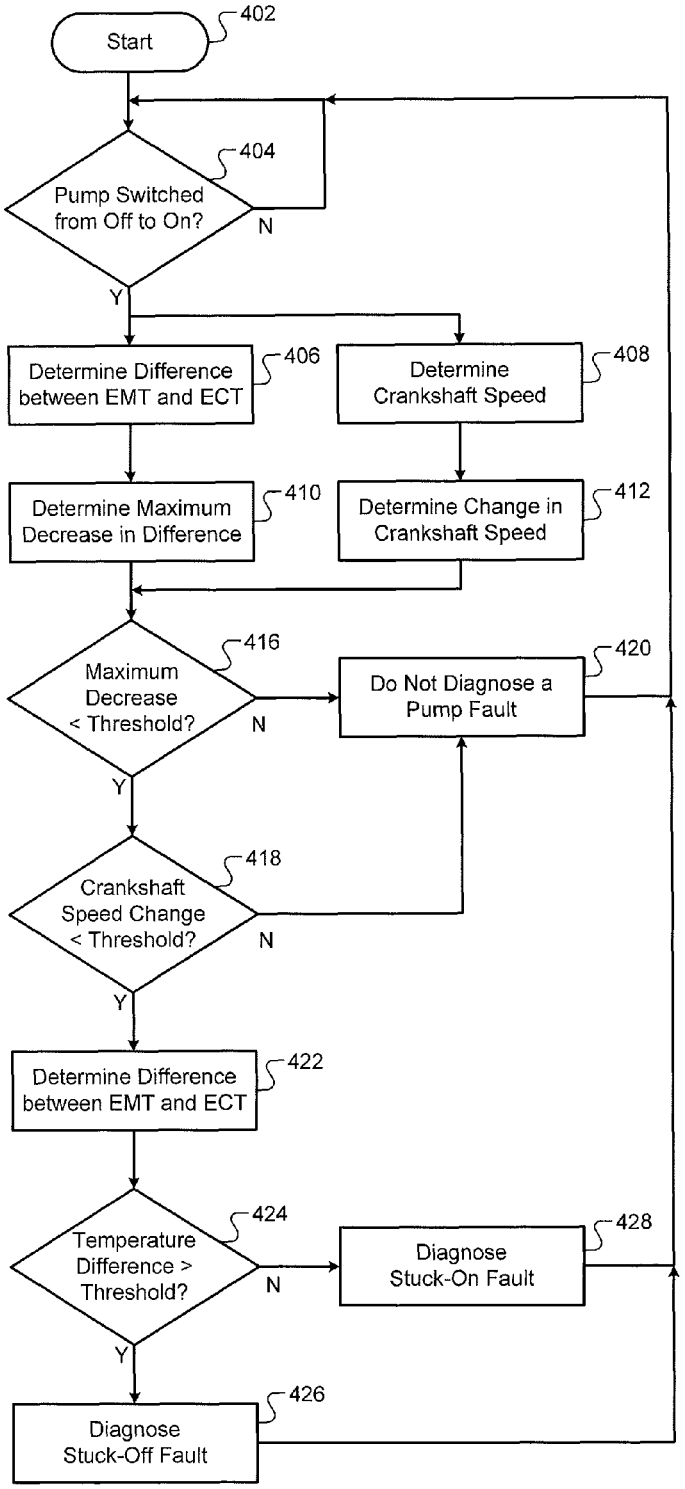

Referring now to FIG. 4, a method for diagnosing faults in a switchable water pump based on an engine coolant temperature, an engine material temperature, and a change in crankshaft speed starts at 402. At 404, the method determines whether the water pump is switched from off to on. If the water pump is switched on or off, the method continues in parallel at 406 and 408. Otherwise, the method continues at 404.

At 406, the method determines a first difference between the engine material temperature and the engine coolant temperature. The method may continue to determine the first difference after the water pump is switched on. At 410, the method determines a maximum decrease in the first difference during a diagnostic period. The diagnostic period may start when the water pump is switched on and may have a predetermined duration (e.g., 12 seconds).

The method may determine the maximum decrease based on a second difference between a maximum value and a minimum value of the first difference during the diagnostic period. The method may determine the maximum value of the first difference during a first portion of the diagnostic period. The method may determine the minimum value of the first difference during a second portion of the diagnostic period that follows the first portion. The first portion may have a predetermined duration (e.g., 3 seconds) and the second portion may have a predetermined duration (e.g., 9 seconds). The sum of the predetermined duration of the first portion and the predetermined duration of the second portion may be equal to the predetermined duration of the diagnostic period.

At 408, the method determines the crankshaft speed. The method may determine the crankshaft speed based on input received from a crankshaft position sensor. At 412, the method determines a change in the crankshaft speed. The crankshaft speed change may include crankshaft acceleration and/or crankshaft jerk.

At 416, the method determines whether the maximum decrease in the first difference during the diagnostic period is less than a first threshold. The method may determine the first threshold based on ambient temperature, which may be measured or estimated. The first threshold may be a predetermined value (e.g., 4° C.) or within a predetermined range (e.g., 2° C. to 5° C.). If 416 is true, the method continues at 418. Otherwise, the method continues at 420 and does not diagnose a pump fault.

At 418, the method determines whether the crankshaft speed change is less than a second threshold, which may be a predetermined value. For example, the method may determine whether the crankshaft acceleration is less than a predetermined acceleration and/or whether the crankshaft jerk is less than a predetermined jerk. If the crankshaft speed change is less than the second threshold, the method continues at 422. Otherwise, the method continues at 420.

At 422, the method determines the first difference between the engine material temperature and the engine coolant temperature at the end of the diagnostic period. At 424, the method determines whether the first difference at the end of the diagnostic period is greater than a third threshold. The third threshold may be a predetermined value (e.g., 6° C.) or within a predetermined range (e.g., 5° C. to 12° C.). If 424 is true, the method continues at 426 and diagnoses a stuck-off fault. Otherwise, the method continues at 428 and diagnoses a stuck-on fault. The methods described above with respect to FIGS. 3 and 4 may set a diagnostic trouble code, activate a service indicator, and/or limit the torque output of an engine when a pump fault is diagnosed.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

a pump control module that commands a water pump to switch between on and off, wherein the water pump circulates coolant through an engine when the water pump switches on as commanded;

a speed change module that determines a change in a crankshaft speed of the engine when the water pump is commanded to switch between on and off; and a pump diagnostic module that diagnoses a fault in the water pump when the change in the crankshaft speed is less than a first predetermined value.

2. The system of claim 1 wherein the pump diagnostic module diagnoses a fault in the water pump when a crankshaft acceleration associated with the engine is less than a predetermined acceleration after the water pump is commanded to switch between on and off.

3. The system of claim 1 wherein the pump diagnostic module diagnoses a fault in the water pump when a crankshaft jerk associated with the engine is less than a predetermined jerk after the water pump is commanded to switch between on and off.

4. The system of claim 1 wherein the pump diagnostic module diagnoses a fault in the water pump based on a first difference between an engine material temperature and an engine coolant temperature when the water pump is switched from off to on, wherein the engine material temperature is a temperature of at least one of an engine block and a cylinder head of the engine.

5. The system of claim 4 wherein the pump diagnostic module diagnoses a fault in the water pump based on a decrease in the first difference during a period after the water pump is commanded to switch between on and off.

6. The system of claim 5 wherein the pump diagnostic module diagnoses a fault in the water pump when the decrease in the first difference during the period is less than a second predetermined value and the change in the crankshaft speed is less than the first predetermined value.

7. The system of claim 6 wherein the pump diagnostic module diagnoses a stuck-off fault in the water pump when the first difference is greater than a third predetermined value at an end of the period.

8. The system of claim 7 wherein the pump diagnostic module diagnoses a stuck-on fault in the water pump when the first difference is less than or equal to the third predetermined value at the end of the period.

9. The system of claim 1 further comprising a torque limit module that limits a torque output of the engine when a fault in the water pump is diagnosed.

10. The system of claim 1 further comprising an indicator activation module that activates a service indicator when a fault in the water pump is diagnosed.

11. A method comprising:

commanding a water pump to switch between on and off, wherein the water pump circulates coolant through an engine when the water pump switches on as commanded;

determining a change in a crankshaft speed of the engine when the water pump is commanded to switch between on and off; and diagnosing a fault in the water pump when the change in the crankshaft speed is less than a first predetermined value.

12. The method of claim 11 further comprising diagnosing a fault in the water pump when a crankshaft acceleration associated with the engine is less than a predetermined acceleration after the water pump is commanded to switch between on and off.

13. The method of claim 11 further comprising diagnosing a fault in the water pump when a crankshaft jerk associated with the engine is less than a predetermined jerk after the water pump is commanded to switch between on and off.

14. The method of claim 11 further comprising diagnosing a fault in the water pump based on a first difference between an engine material temperature and an engine coolant temperature when the water pump is switched from off to on, wherein the engine material temperature is a temperature of at least one of an engine block and a cylinder head of the engine.

15. The method of claim 14 further comprising diagnosing a fault in the water pump based on a decrease in the first difference during a period after the water pump is commanded to switch between on and off.

16. The method of claim 15 further comprising diagnosing a fault in the water pump when the decrease in the first difference during the period is less than a second predetermined value and the change in the crankshaft speed is less than the first predetermined value.

17. The method of claim 16 further comprising diagnosing a stuck-off fault in the water pump when the first difference is greater than a third predetermined value at an end of the period.

18. The method of claim 17 further comprising diagnosing a stuck-on fault in the water pump when the first difference is less than or equal to the third predetermined value at the end of the period.

19. The method of claim 11 further comprising limiting a torque output of the engine when a fault in the water pump is diagnosed.

20. The method of claim 11 further comprising activating a service indicator when a fault in the water pump is diagnosed.

21. The system of claim 1 wherein the pump diagnostic module diagnoses a fault in the water pump when an absolute value of the change in the crankshaft speed is less than the first predetermined value.

22. The method of claim 11 further comprising diagnosing a fault in the water pump when an absolute value of the change in the crankshaft speed is less than the first predetermined value.

* * * * *